United States Patent [19]

Rhoades

[11] Patent Number: 4,838,131

[45] Date of Patent: Jun. 13, 1989

[54] NUT STARTER

[76] Inventor: Clark J. Rhoades, 181 Tweed Blvd., Nyack, N.Y. 10960

[21] Appl. No.: 154,097

[22] Filed: Feb. 9, 1988

[51] Int. Cl.[4] ..... B25B 13/00

[52] U.S. Cl. ..... 81/57.43; 81/448

[58] Field of Search ..... 81/55, 56, 57.14, 57.3, 81/57.43, 57.26, 57.27, 436, 438, 448, 461, 439

[56] References Cited

U.S. PATENT DOCUMENTS

| | | | |
|---|---|---|---|
| 1,903,660 | 4/1933 | Smith et al. | 81/57.43 |
| 2,679,778 | 6/1954 | Krafft | 81/439 |
| 3,138,893 | 6/1964 | Frizzell | 81/57.3 |
| 3,283,621 | 11/1966 | Faso | 81/57.3 |
| 3,853,025 | 12/1974 | Komhyr | 81/448 |
| 3,913,428 | 10/1975 | Brunson | 81/57.43 |
| 3,987,691 | 10/1976 | Savage | 81/57.3 |
| 4,287,795 | 9/1981 | Curtiss | 81/57.26 |

FOREIGN PATENT DOCUMENTS

| | | | |
|---|---|---|---|
| 594111 | 11/1947 | United Kingdom | 81/439 |

*Primary Examiner*—James G. Smith

*Attorney, Agent, or Firm*—John H. Crozier

[57] ABSTRACT

In one embodiment, there is provided an axial nut starter having a nut engaging member which can be used with a wide range of nut sizes. The nut engaging member is in the form of a stepped series of stacked, coaxially aligned cylinders. The base, or the largest cylinder, of the nut engaging member is attached to an elongated handle. The top, or the smallest cylinder, of the cone is inserted into the nut until the wall of one of the cylinders frictionally engages the threads of the nut and the face of the nut shoulders against the top of the next larger cylinder. Unitary rotational movement of the handle and the nut engaging member starts the nut on the fastener. In another embodiment, an offset nut starter is provided which permits the starting of a nut on a fastener when it is impossible to reach the fastener along its axis. This embodiment comprises an elongate tool having the nut engaging member rotatably disposed at one end thereof, with the major axis of the nut engaging member orthogonal to the major axis of the tool. Driving means located on the tool, remote from the nut engaging member and operatively connected to the nut engaging member permits remotely rotating the nut engaging member so as to advance the nut onto the fastener.

5 Claims, 1 Drawing Sheet

FIG. 1
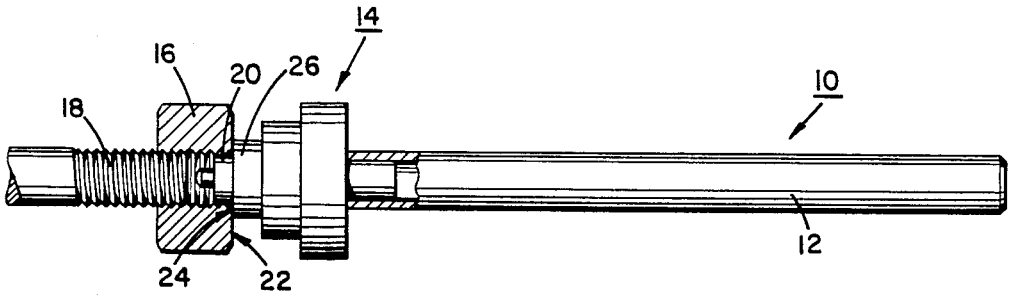
FIG. 2
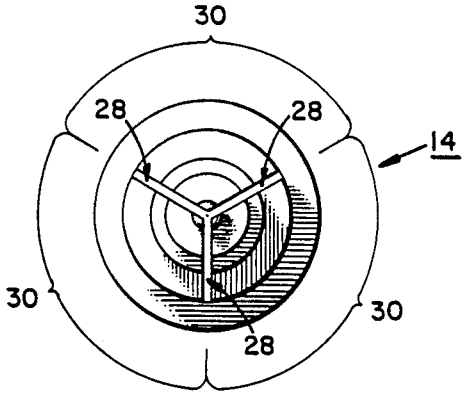
FIG. 3
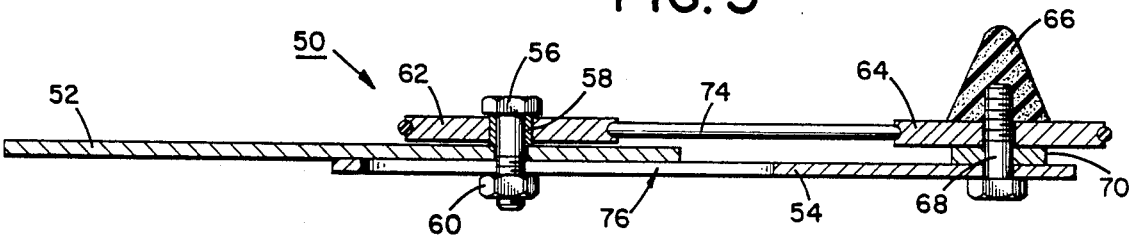
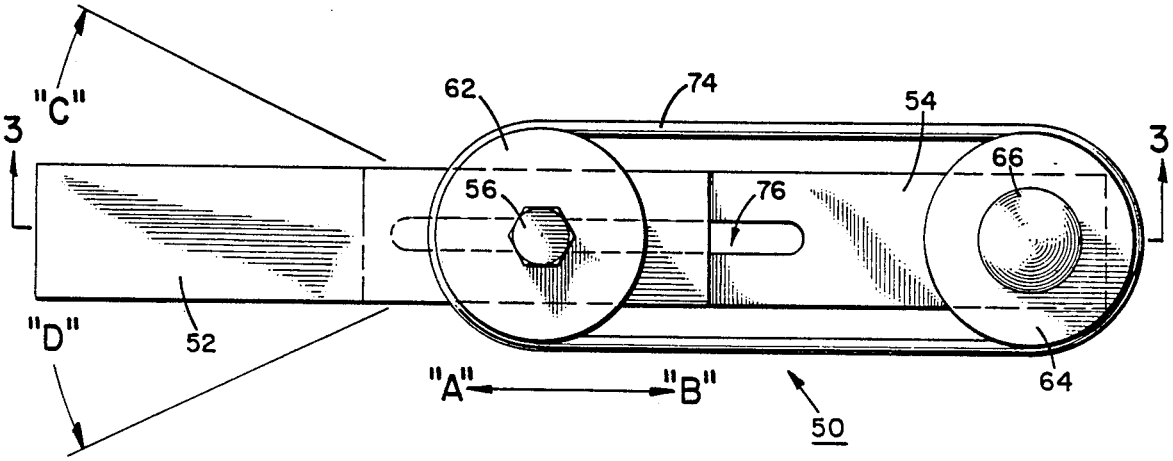
FIG. 4

NUT STARTER

BACKGROUND OF THE INVENTION

1. Field of the Invention

The present invention relates to mechanical hand tools, generally, and, more particularly, to an implement for starting a nut or other threaded item onto a bolt, stud, or other threaded fastener where such fastener is located such that it cannot be conveniently reached by the fingers of one trying to start the nut or other threaded item thereon.

2. Background Art

Situations frequently occur where it is necessary to start a nut or other threaded item onto a bolt, stud, or other threaded fastener for subsequent tightening with a wrench or other tightening device, but where the fastener is located such that it is difficult or impossible to place and turn the nut by hand onto the threads of the fastener.

U.S. Pat. No. 3,853,025, to Komhyr, issued Dec. 10, 1974, titled "Nut Starter", addresses the problem by providing a generally cylindrical, elongate body having at one end an axial extension of reduced diameter which frictionally engages one internally threaded end of a nut so that the nut is held by the extension and can be picked up by the extension without the nut having been touched by hand. A shoulder portion between the axial extension and the end of the body engages the outer face of the nut and the nut can be started on the fastener by the unitary rotational movement of the body, the axial extension, and the shoulder. This arrangement has two substantial limitations. First, the configuration of the axial extension greatly limits the size range of nuts that can be accommodated with a given nut starter. Second, the starter can be used only when the fastener is accessible along its axis.

Accordingly, it is a principal object of the present invention to provide an axial nut starter that can be used with a wide range of nut sizes.

It is another object of the present invention to provide an offset nut starter that can be used when the fastener is inaccessible along its axis.

It is a further object of the present invention to provide a nut starter that is simple and economical to manufacture and convenient to use.

Other objects of the present invention will, in part, be obvious, and will, in part, be apparent from the following description and the accompanying drawing figures.

SPECIFICATION

The present invention achieves the above objects by providing, in one embodiment, an axial nut starter having a nut engaging member which can be used with a wide range of nut sizes. The nut engaging member is in the form of a stepped series of stacked, coaxially aligned cylinders. The base, or the largest cylinder, of the nut engaging member is attached to an elongate handle. The top, or the smallest cylinder, of the cone is inserted into the nut until the wall of one of the cylinders frictionally engages the threads of the nut and the face of the nut shoulders against the top of the next larger cylinder. Unitary rotational movement of the handle and the nut engaging member starts the nut on the fastener.

In another embodiment, an offset nut starter is provided which permits the starting of a nut on a fastener when it is impossible to reach the fastener along its axis. This embodiment comprises an elongate tool having the nut engaging member rotatably disposed at one end thereof, with the major axis of the nut engaging member orthogonal to the major axis of the tool. Driving means located on the tool, remote from the nut engaging member and operatively connected with the nut engaging member, permits remotely rotating the nut engaging member so as to advance the nut onto the fastener.

BRIEF DESCRIPTION OF THE DRAWING

FIG. 1 is a partially cross-sectional side view of an axial nut starter according to the present invention.

FIG. 2 is a top plan view of a nut engaging cone according to the present invention.

FIG. 3 is a cross-sectional side view of an offset nut starter according to the present invention.

FIG. 4 is a top plan view of the offset nut starter of FIG. 3.

DESCRIPTION OF THE PREFERRED EMBODIMENTS

Referring now to the Drawing, FIG. 1 shows an axial nut starter constructed in accordance with the present invention, generally indicated by the reference numeral 10, which includes an elongate handle 12 having mounted at one end thereof a nut engaging member comprising a stepped series of stacked, coaxially aligned cylinders, generally indicated by the reference numeral 14 which is shown having engaged a threaded nut 16 and started it into engagement with the threaded end of a fastener 18.

Elongate handle 12 may be of any convenient length or shape and may be of any suitable material; the precise configuration or material not being critical to the practising of the present invention. Preferably, the material of elongate handle 12 is formed of a relatively rigid metal, wood, polymer, or other material known in the art. Alternatively, elongate handle 12 may be formed of a flexible material, so as to allow use of nut starter 10 in situations where there may be an obstruction in line with the axis of fastener 18. Stepped nut engaging member 14 is preferably formed of a relatively resilient material, such as a rubber or a polymer, to aid in holding a nut in place and to aid in holding and turning the nut and may include a magnetic element (not shown) to aid in holding nuts that are attracted by magnets. Nut engaging member 14 may be adhesively or mechanically attached to elongate handle 12 by any means known in the art, the one chosen not being critical to the practising of the present invention, or it may be frictionally held in the handle, as indicated on FIG. 1. Nut engaging member 14 may be permanently fixed on elongate handle 12 or it may be removable to permit attachment of nut engaging members of other sizes.

In operation, and again referring to FIG. 1, nut engaging member 14 is inserted into nut 16 until the wall of one of the cylinders or segments of nut engaging member 14, here, segment 20, resiliently grasps the threads of the nut. At this point, face 22 of 16 nut has engaged face 24 of adjacent segment 26. Being so engaged by nut starter 10, nut 16 is held by the nut starter and may be moved into position against the end of threaded fastener 18. Axial force is now applied to nut starter 10 in the direction of threaded fastener 18, so that frictional force between face 22 of nut 16 and face 24 of segment 26 allows the nut to be started onto the threaded fastener by the unitary rotational movement of handle 12, nut engaging member 14, and the nut. Having the threads of nut 16 engaging segment 20 of nut engaging member 14 and having face 22 of the nut engaging face 24 of the nut engaging member, helps ensure that the central axis of the nut is in line with the central axis of the nut engaging member and that the face of the nut is perpendicular to the central axis of the nut engaging member. Therefore, when nut starter 10 is rotated, nut 16 will turn without wobbling. This facilitates the engagement of the threads of nut 16 and fastener 18, thus minimizing the possibility of the threads crossing. Once nut 16 has been started, light axial force in the opposite direction will release nut engaging member 14 from nut 16.

FIG. 2 is a top plan view of a construction of nut engaging member 14 which offers improved grasping of a nut. Here, nut engaging member 14 had formed therein one or more slots, in this case, three slots 28 which divide one or more terraces of the nut engaging member into three sections 30. The resilient sections are slightly forced toward the central axis of nut engaging member 14 as that member is inserted into a nut (not shown), with the resulting complementary outward force aiding in grasping the nut. A particular advantage of this arrangement is that the material of which nut engaging member 14 is formed may be less resilient than otherwise, thus leading to longer life of that member, since deformation of the surface of that member becomes a less important factor in holding the nut in place.

FIG. 3 is a cross-sectional side view and FIG. 4 is a top plan view of an offset nut starter of the present invention, generally indicated by the reference numeral 50, which includes an elongate handle 52 with an elongate handle extension 54. Handle 52 and handle extension 54 are joined by means of bolt 56 extending through sleeve 58, handle 52, and slot 76 in handle extension 54 and into nut 60. Rotatably disposed around sleeve 58 is pulley 62. Rotatably mounted at the dital end of handle extension 54 is pulley 64, lying in substantially the same plane as pulley 62, upon which pulley 64 is mounted resilient nut engaging member 66. Nut engaging member 66 is rotatably fastened to handle extension 54 by means of a threaded bolt 68 which passes through handle extension 54, through spacer/bearing 70, and into nut engaging member 66. Pulleys 62 and 64 are operatively connected for mutual rotation by flexible belt 74.

The overall length of offset nut starter 50 can be adjusted along the axis "A"-"B" by means of loosening nut 60, moving handle 52 and handle extension 54 relative to each other, and retightening the nut. Flexible belt 74 may be used in the new position if it has sufficient elasticity, or another belt may be substituted. Handle 52 may also be rotated about nut 56 in the directions "C" or "D" to form an angle with handle extension 54, if such is desirable to avoid obstructions.

The materials of which the various elements of offset nut starter 50 are formed may be of any known in the art having appropriate physical properties for their uses, the ones selected not being critical to the practising of the present invention. Preferably, nut engaging member 66 is a resilient material such as a rubber or a synthetic polymeric material, flexible belt 74 is rubber, rubber/-fabric composite, or synthetic polymeric material, and spacer/washer 70 has sufficient lubricity relative to pulley 64 and/or handle extension 54 to prevent binding thereof. All other elements of offset nut starter 50 may be of any wood, metal, and/or polymeric material known in the art which has sufficient rigidity for the purpose intended.

In operation, nut engaging member 66 is inserted in a nut (not shown) as described above. The nut is then held against a threaded fastener (not shown) and the perimeter of pulley 62 is manually grasped and rotated. Alternatively, knob means (not shown) may be provided at the central axis of pulley 62 for convenient manual grasping and rotation. Belt 74 transmits the rotational movement to pulley 64 and nut engaging member 66 causes the nut to advance onto the fastener.

It is also within the scope of the present invention to use means other than pulley 62 and 64 with flexible belt 74 therebetween, such as various direct mechanical linkages known in the art, to translate motion to nut engaging member 66 from a point distant on handle 52 and handle extension 54, in which case the length of offset nut starter 50 could not be conveniently adjusted without changing the mechanical linkage.

It will thus be seen that the objects set forth above, among those made apparent from the preceding description are efficiently attained and, since certain changes may be made in the above construction without departing from the scope of the invention, it is intended that all matter contained in the above description or shown on the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A nut starter for nuts of the type each having an internally threaded, centrally disposed, cylindrical opening extending therethrough between first and second faces thereof, comprising:

(a) a resilient nut engaging member, comprising a stepped series of at least two cylinders decreasing in diameter from the base thereof to the top thereof, a surface of each said cylinder being substantially orthogonal to the central axis of said nut engaging member and a wall of each said cylinders being substantially parallel with said central axis, the top of which member may be advanced into the end of said cylindrical opening at said first face of said nut until the wall of one of said cylinders engages the threads of said nut and one of said surfaces of said cylinders engages said first face of said nut, thereby to releasably hold said nut thereon;

(b) mounting means secured to the base of said nut engaging member, which mounting means may be manually positioned to bring said cylindrical opening at said second face of said engaged nut into contact with the end of a threaded fastener and engage the threads thereof, said mounting means having its major axis substantially orthogonal to the central axis of said nut engaging member;

(c) said mounting means comprises an elongate handle having first and second ends;

(d) said nut engaging member is rotatably mounted near said first end of said elongate handle, with the central axis of said nut engaging member substantially orthogonal to the major axis of said elongate handle; and (e) said elongate handle includes motion translating means to translate manually generated motion to said nut engaging member from a point on said elongate handle distant from said first end of said elongate handle, so as to cause said nut engaging means to rotate; whereby, when said nut engaging member is grippingly advanced into said nut and said second end of said elongate handle is manually grasped so as to move said cylindrical opening at said second face of said nut into contact with said threaded fastener, said manually generated motion will cause said nut to rotate and to advance onto said threaded fastener.

2. A nut starter, as defined in claim 1, wherein said motion translating means, comprises:

(a) first pulley means rotatably mounted near said first end of said elongate handle, upon which first pulley means is mounted said nut engaging member for unitary rotation therewith;

(b) second pulley means rotatably mounted at a point on said elongate handle distant from said first end of said elongate handle; and (c) means operatively connecting said first and second pulley means to translate rotational motion from said second pulley means to said first pulley means so as to cause rotation of said nut engaging means.

3. A nut starter, as defined in claim 2, wherein said rotational motion is generated by manually causing said second pulley means to rotate.

4. A nut starter, as defined in claim 1, further comprising means to selectively shorten or lengthen said elongate handle.

5. A nut starter, as defined in claim 1, further comprising means to selectively set the major axis of said second end of said elongate handle at an angle to the major axis of said first end of said elongate handle.

* * * * *